United States Patent [19]

Göbelt

[11] 4,273,528

[45] Jun. 16, 1981

[54] GAS LIGHTER

[75] Inventor: Reiner Göbelt, Offenbach am Main, Fed. Rep. of Germany

[73] Assignee: Rowenta-Werke, GmbH, Offenbach am Main, Fed. Rep. of Germany

[21] Appl. No.: 966,937

[22] Filed: Dec. 5, 1978

[30] Foreign Application Priority Data

Dec. 8, 1977 [DE] Fed. Rep. of Germany ..... 2754639

[51] Int. Cl.[3] ..... F23Q 7/12

[52] U.S. Cl. ..... 431/255; 361/260

[58] Field of Search ..... 431/203, 254–256; 361/258, 260

[56] References Cited

U.S. PATENT DOCUMENTS

| | | | |
|---|---|---|---|
| 3,150,507 | 9/1964 | Smith | 67/7.1 |
| 3,413,070 | 11/1968 | Piffath et al. | 431/89 |
| 3,484,178 | 12/1969 | Weissmann | 431/276 |
| 3,523,005 | 8/1970 | Piffath et al. | 431/344 |
| 3,541,360 | 11/1970 | Tonari | 431/255 X |
| 3,580,698 | 5/1971 | Goto | 431/255 |
| 3,729,639 | 4/1973 | Heinouchi et al. | 361/260 X |
| 3,820,941 | 6/1974 | Piffath et al. | 431/254 |
| 3,883,289 | 5/1975 | Fujioka | 431/131 |
| 3,891,381 | 6/1975 | Moriya | 431/255 |
| 3,938,942 | 2/1976 | Torassa | 431/142 |
| 3,970,420 | 7/1976 | Goto | 431/255 |
| 3,989,445 | 11/1976 | Kojima | 431/256 |
| 4,069,006 | 1/1978 | Jackson | 431/344 |

FOREIGN PATENT DOCUMENTS

| | | |
|---|---|---|
| 83451 | 5/1978 | Australia . |
| 1944643 | 5/1970 | Fed. Rep. of Germany . |
| 2444806 | 4/1976 | Fed. Rep. of Germany . |
| 1587972 | 2/1970 | France . |

*Primary Examiner*—Robert S. Ward, Jr.

*Attorney, Agent, or Firm*—George R. Clark; Neil M. Rose; Allen J. Hoover

[57] ABSTRACT

A gas lighter comprises a cylindrical tank having a filler valve and a burner valve connected to a burner by a conduit. An electrical ignition device is enclosed within a semi-cylindrical holder and a semi-cylindrical, axially displaceable actuating member, the actuating member being provided with means for operating the ignition device and means for opening the burner valve. The tank holder and actuating member are surrounded and held together by a one-part tubular sleeve having an aperture to permit manual movement of the actuating member.

10 Claims, 5 Drawing Figures

GAS LIGHTER

BACKGROUND OF THE INVENTION

The invention relates to a gas lighter of a type comprising a tank, which is provided with a burner valve connected to a combustion space by a conduit, and also comprising an electrical ignition device.

Such lighters with battery ignition, friction-wheel ignition, or even spontaneous ignition are known. In one known form of lighter, the tank and a battery ignition device are arranged next to one another on a cylindrical axis. The outer lighter sleeve consists of two tubular parts of equal diameter which lie on a common axis and are connected releasably to one another. This form of construction has several considerable disadvantages. Firstly, to fill the tank, the lighter has to be dismantled, since the filler valve is arranged on the inside of the lighter and is accessible only in the dismantled state. Secondly, operation is extremely impractical, since the two tubular parts of the outer sleeve have to be displaced in opposition in an axial direction, which can only be performed with two hands. Thirdly, the lighter consists of a plurality of individual parts which are connected to one another by screwing or by means of exact fits. Consequently, manufacture and maintenance involve high costs. Fourthly, the tank is arranged between the ignition device and burner mouth, so that the high-voltage line to the ignition electrode has to be laid past the tank via a long connection which also needs to be made so that it can be broken by an expensive spring-/ball contact.

SUMMARY OF THE INVENTION

To overcome the aforesaid disadvantages, the object of the invention is to provide a lighter which is simple to assemble and whose individual parts can be replaced easily even by a layman.

According to the invention, there is provided a gas lighter comprising a cylindrical tank provided with a burner valve, the burner valve being connected to a burner or combustion space by a conduit, an electrical ignition device mounted in a substantially semi-cylindrical holder and covered by a semi-cylindrical axially displaceable actuating member, the actuating member being provided with means for operating the ignition device and means for opening the burner valve, and a one-piece tubular sleeve surrounding and holding together the tank, the holder, and the actuating member, the sleeve having an aperture therein to permit manual movement of the actuating member.

To enable the burner valve to be easily fitted and adjusted in order to set the flame size, a valve operator preferably is arranged displaceably on the actuating member and engages with the burner valve. In a further preferred feature of the invention, a projection is molded on the casing of the tank in the region of the filler valve and in the assembled condition, a recess in the sleeve fits over the projection, thus enabling all the individual parts of the lighter to be located in the one-piece tubular outer sleeve without any screw connections. The individual parts are shaped so that they fit together by means of pin and slot like connections. The few individual parts which make up the lighter according to the invention can be assembled very quickly. A repair, also, can be carried out rapidly and without a tool even by a layman. Due to the arrangement of the filler valve in the base of the lighter, the tank can be filled without any assembly work. An operating member is preferably arranged so that a gripping portion for the hand remains underneath it, thus allowing comfortable handling.

BRIEF DESCRIPTION OF THE DRAWINGS

The invention is described hereinafter in detail with respect to the accompanying drawings, in which.

DETAILED DESCRIPTION OF PREFERRED EMBODIMENTS

Figure 4:
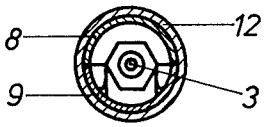
FIG. 4 is a section on line 4—4 of FIG. 2.

As shown in FIGS. 1 through 4 of the drawings, a preferred embodiment of a gas lighter according to this invention is characterized by a one-piece tubular sleeve 12, which is open at its opposite ends, and which telescopes over several other componens of the lighter so as to secure such other components in cooperative relation to each other, and so as to prevent disassembly of such other components except when the sleeve 12 has been removed. Preferably, the sleeve 12 is circular in internal cross-section, as shown in FIG. 4.

Among the other components secured by the sleeve as mentioned above is a unitary tank 1, which may be molded of a suitable plastic, and which holds butane or other suitable fuel. The tank 1 is provided with a filler valve 2, at its lower end as shown in FIG. 1, and with a burner valve 3, at its upper end as shown in FIG. 1.

The burner valve 3 is provided with a valve stem 3*a*, which is movable axially so as to open the burner valve 3 when pulled outwardly, and so as to close the burner valve 3 when pushed inwardly. The valve stem 3*a* is biased inwardly in a conventional way.

The burner valve 3 is connected, by means of a flexible conduit or tube 4, with a burner 5, which receives fuel from the tank 1 through the tube 4 whenever the burner valve 3 is opened, and thus whenever the valve stem is pulled outwardly. A piezo-electric ignition device 6 is arranged so as to be actuated by depression of a plunger 6*a*.

Figure 1:
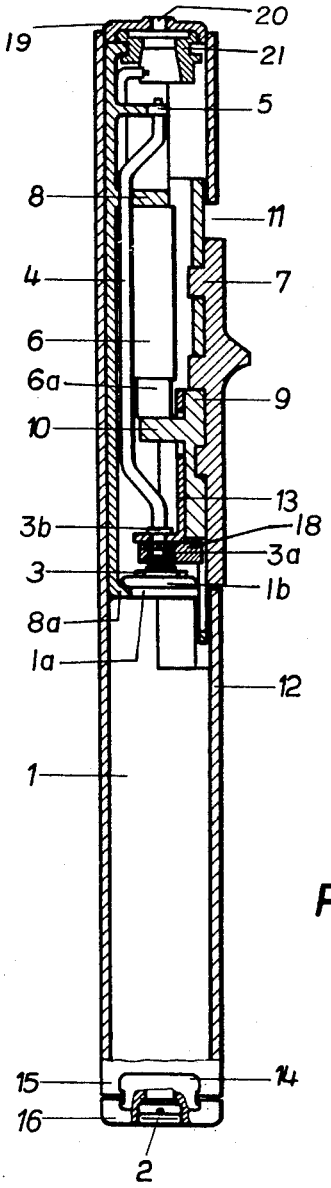
FIG. 1 is a cross-section through a preferred embodiment of a gas lighter according to the invention.
Figure 2:
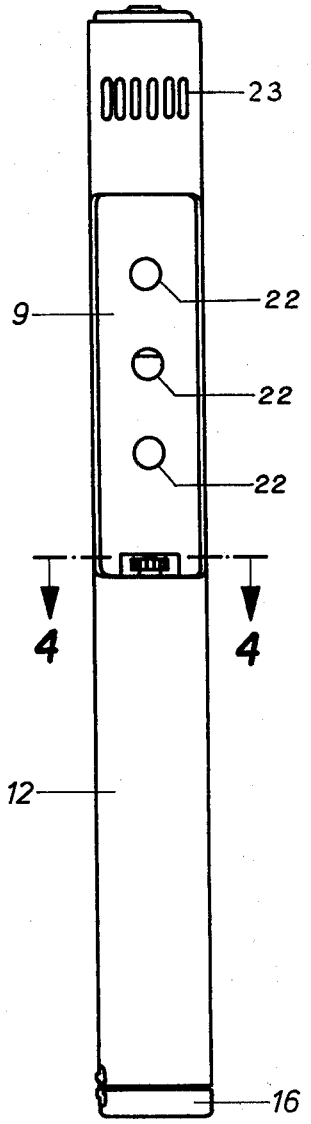
FIG. 2 is an elevation from the right side of the lighter of FIG. 1 with an operating member removed.
Figure 3:
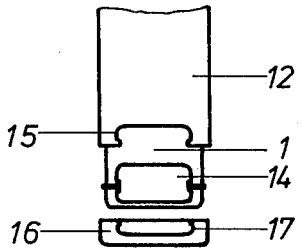
FIG. 3 is a partly exploded view of the lower end of the lighter of FIGS. 1 and 2, to a fuel tank partially pulled out of a sleeve and to show a cap removed from the lower end of the fuel tank.

The plunger may be depressed, upwardly as shown in FIG. 1, so as to generate a spark between two electrodes (not shown) for ignition of fuel fed through the tube 4. The plunger 6*a* is biased, downwardly as shown in FIG. 1, by conventional means (not shown) within the ignition device 6.

At the upper end of the lighter as shown in FIG. 1, a cap 19 fits within the sleeve 12 and defines a flame orifice 20 of predetermined size. The cap 19 is affixed to a burner element 21 fitting into the sleeve 12 and defining a combustion zone. Air flow into the burner 5 is permitted by suitable orifices 23 (FIG. 2) in the sleeve 12. The filler valve 2, the burner valve 3, and the piezo-electric ignition device 6 are similar in structure and function to analogous components used in known gas lighters. Hence, further details of these components are not necessary to comprehension of this invention, and such details have been omitted from FIGS. 1 through 4 as described herein.

The tank 1 is molded of a suitable plastic or made otherwise so as to have a push fit within the sleeve 12, except at its lower end as shown in FIG. 1, where a cap 16 is affixed to the tank 1 so as to permit longitudinal displacement of the tank 1 only in one direction with respect to the sleeve 12. As shown in FIG. 1, the filler valve 2 is accessible through the cap 16 so as to permit the tank 1 to be filled in conventional manner but without prior removal of the sleeve 12.

The burner element 21 and the ignition device 6 are seated in a holder 8 which has a semi-cylindrical shape so as to fit within the sleeve 12, and which is connected to the tank 1, at the upper end of the tank 1 as shown in FIG. 1, so as to prevent relative displacement of the holder 8 and the tank 1 either rotationally or longitudinally, and so as to prevent disassembly of the holder 8 and the tank 1 when the sleeve 12 is telescoped over the several components secured by the sleeve 12. Thus, a non-circular neck 1*a* of the tank 1 fits transversely into a complementarily shaped slot in a transverse wall 8*a* of the holder 8, so as to prevent relative displacement of the holder 8 and the tank 1 rotationally. Also, a near surface on the tank 1 and an enlarged boss 1*b* on the neck 1*a* straddle the same wall 8*a* at margins of the slot, so as to prevent relative displacement of the holder 8 and the tank 1 longitudinally.

An actuating member 9 of semi-cylindrical shape fits slidably against the holder 8, so as to form a cylindrical subassembly comprising the holder 8 and the member 9 and having a push fit within the sleeve 12. Thus, the holder 8, the member 9, and the tank 1, which is connected to the holder 8 as described above, can be pushed into the sleeve 12 or pulled from the sleeve 12 as suggested by FIG. 3, for assembly or disassembly.

On its inner side, the member 9 is formed with an integral portion 10, which depresses the plunger 6*a* so as to actuate the ignition device 6 upon longitudinal displacement of the member 9 within the sleeve 12, along the holder 8, and toward the burner 5. Opposite displacement of the member 9, in a direction to which the member 9 is biased through the integral portion 10 by the aforesaid means (not shown) biasing the plunger 6*a*, is permitted by suitable relief on the tank 1.

Also on its inner side, the member 9 carries a valve operator 13, which is L-shaped as shown in FIG. 1, a transverse portion of which engages an annular element 3*b* carried by the valve stem 3*a* so as to open the burner valve 3 upon longitudinal displacement of the member 9 to actuate the ignition device 6, and which has a slot passing the integral portion 10 of the member 9 and allowing relative displacement of the member 9 and the valve operator 13 so as to enable the burner valve 3 to be easily fitted and adjusted in order to set the flame size.

The sleeve 12 is provided with an actuating aperture 11 through which an operating member 7 engages the actuating member 9. Plural connecting bosses on the operating member 7, on its inner side, snap into suitable receiving apertures 22 (FIG. 2) in the actuating member 9, so as to facilitate assembly and disassembly of the operating member 7 and the actuating member 9. The operating member 7 is assembled to the actuating member 9 after the sleeve 12 is telescoped over the several components secured by the sleeve 12, and after a cotter 18 to be described below is inserted.

The cotter 18, which is yoke-shaped, straddles the burner valve 3 between annular elements 13 and 1*b* on the burner valve 3 so as to limit longitudinal displacement of the actuating member 9 toward the tank 1. The cotter 18 is inserted, through the actuating aperture 11, after the sleeve 12 is telescoped over the several components secured by the sleeve 12, but before the operating member 7 is attached.

Near its lower end as shown in FIG. 1, the tank 1 is molded or provided otherwise with an integral projection 14, which is seated in a complementary recess 15 in the sleeve 12 and a complementary recess 17 in the cap 16, so as to assure rotational alignment of the sleeve 12 and the tank 1 for proper assembly of the lighter.

Figure 5:
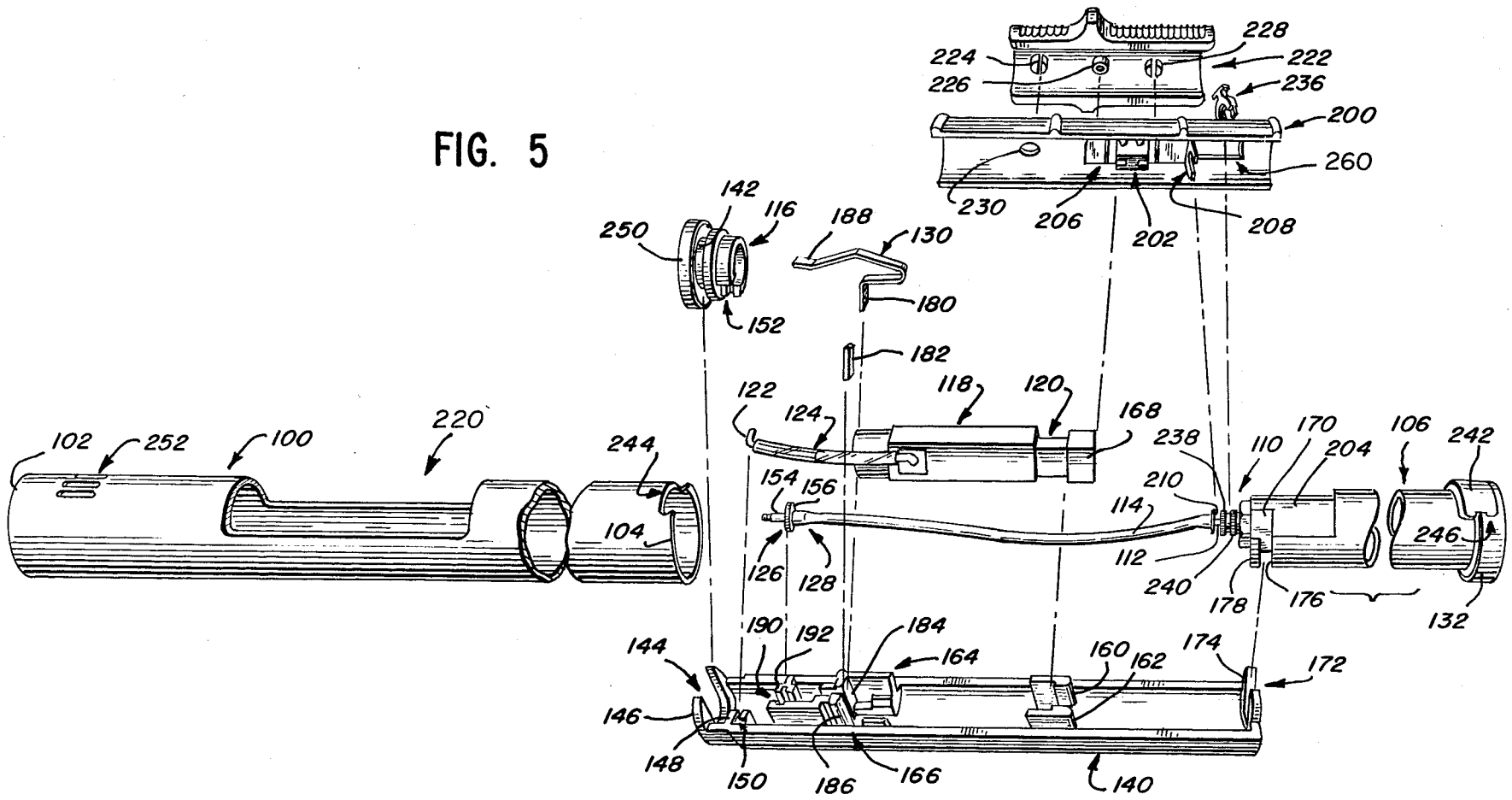
FIG. 5 is an exploded view, in perspective, of a gas lighter according to an alternative embodiment of this invention and corresponding essentially to the preferred embodiment of FIG. 1.

As shown in FIG. 5, an alternative embodiment of a gas lighter according to this invention is similar to the preferred embodiment shown in FIGS. 1 through 4 and described above, except for certain constructional details described below. The lighter of FIG. 5 is characterized by a one-piece tubular sleeve 100, which is open at its opposite ends 102 and 104, and which telescopes over several other components of the lighter so as to secure such other components in cooperative relation to each other, as in the lighter of FIGS. 1 through 4.

Among the other components secured by the sleeve 100 is a unitary tank 106, which is similar to the tank 1 of FIGS. 1 through 4, and which similarly is provided with a filler valve (not shown), at its right end as shown in FIG. 5, and with a burner valve 110. These valves are similar to analogous valves of FIGS. 1 through 4.

The burner valve 110 is provided with a valve stem 112, which is movable axially so as to open the burner valve 110 when pulled outwardly, and so as to close the burner valve 110 when pushed inwardly. The valve stem 112 is biased inwardly by conventional means (not shown) within the burner valve 110.

The burner valve 110 is connected, by means of a flexible tube 114, with a burner element 116, which receives fuel from the tank 106 through the tube 114 whenever the burner valve 110 is opened, and thus whenever the valve stem 112 is pulled outwardly. A conventional piezo-electric ignition device 118 is arranged so as to be actuated, by depression of a plunger 120 inwardly, leftwardly as shown in FIG. 5, so as to generate a spark between an electrode 122, which is connected to the ignition device 118 by an insulated lead 124, and another electrode 126, which is associated with a distal end 128 of the tube 114 and energized through a leaf spring 130 in a manner to be described below, for ignition of fuel fed through the distal end 128 of the tube 114. The plunger 120 is biased outwardly, rightwardly as shown in FIG. 5, by conventional means (not shown) within the ignition device 118.

The tank 106 is similar to the tank 1 of FIGS. 1 through 4 in that the tank 106 has a push fit within the sleeve 100, except at its right end as shown in FIG. 5, where a cap 132 is affixed to the tank 106 so as to permit longitudinal displacement of the tank 106 only in one direction with respect to the sleeve 100. The tank 106 also is similar in that the filler valve (not shown) is accessible through the cap 130 so as to permit the tank 106 to be filled in conventional manner but without prior removal of the sleeve 100.

The burner element 116 and the ignition device 118 are seated in a holder 140, which has a semi-cylindrical shape so as to fit within the sleeve 100. The burner element 116 has a circumferential groove 142 fitting into a complementary slot 144 in a transverse wall 146 of the holder 140, at the right end of the holder 140 as shown in FIG. 5, so as to prevent relative displacement of the burner enclosure 116 and the transverse wall 146 longitudinally.

As shown in FIG. 5, the burner element 116 is asymetrical rotationally, so as to fit over a transverse abutment 148 extending inwardly from the holder 140 and having a L-shaped channel 150, which accommodates the electrode 122 between the transverse abutment 148 and complementary surface portions 152 recessed in the burner element 116. Thus, the electrode 122 is secured therebetween, for proper orientation of the electrode 122 with respect to the electrode 126.

The electrode 126 comprises a conductive nozzle 154, which is fitted into the distal end 128 of the tube 114, and an annular contactor 156, which is mounted on the nozzle 154. Electrical contact is made between the contactor 156 and a contactor (not shown) on the left end of the ignition device 118 as shown in FIG. 5, through the leaf spring 130, which is made of conductive metal, and which is configured as shown in FIG. 5 so as to be biased away from the contractor 156 when the sleeve 100 is removed, and so as to be bent against the contactor 156 in a manner to be described below.

The ignition device 118 is seated within suitable abutments 160, 162, 164, and 166, which are integral with the holder 140, and which are arranged as shown in FIG. 5. The abutments 160 and 162, at the right end of the ignition device 118 as shown in FIG. 5, allow the tube 114 to pass therebetween, and allow the plunger 120 to operate, but limit depression of the plunger 120 upon engagement of an enlarged portion 168 of the plunger 120 with the abutments 160 and 162.

The holder 140 is similar to the holder 8 of the lighter of FIGS. 1 through 4 in that the holder 140 is connected to the tank 106, at the left end of the tank 106 as shown in FIG. 5, so as to prevent relative displacement of the holder 140 and the tank 106 either rotationally or longitudinally, and so as to prevent disassembly of the holder 140 and the tank 106 when the sleeve 100 is telescoped over the several components secured by the sleeve 100. Thus, a non-circular neck 170 of the tank 106 fits transversely into a complementarily shaped slot 172 in a transverse wall 174 of the holder 140, so as to prevent relative displacement of the holder 140 and the tank 106 rotationally. Also, a near surface 176 on the tank 106 and an enlarged boss 178 on the neck 160 straddle the wall 174 at margins of the slot 172, so as to prevent relative displacement of the holder 140 and the tank 106 longitudinally.

A captive end 180 of the leaf spring 130 is held against the contactor (not shown) on the left end of the ignition device 118 as shown in FIG. 5, by a resilient pad 182, which is held by transverse portions 184 and 186 of the abutments 164 and 166. A distal end 188 of the leaf spring 130 is adapted to engage the contactor 156, which is confined in a suitable slot 190 in a transverse wall 192 of the holder 140, when the leaf spring 130 is bent as described below.

An actuating member 200 of semi-cylindrical shape fits slidably against the holder 140, so as to form a cylindrical subassembly comprising the holder 140 and the member 200 and having a push fit within the sleeve. Thus, the holder 140, the member 200, and the tank 106, which is connected to the holder 140 as described above, can be pushed into the sleeve 100 or pulled from the sleeve 100 as suggested by FIG. 3, for assembly or disassembly.

On its inner side the member 200 is formed with an integral portion 202, which depresses the plunger 120 upon longitudinal displacement of the member 200 within the sleeve 100, along the holder 140, and toward the burner enclosure 116. Such displacement of the member 200 bends the leaf spring 130 so as to cause its distal end 188 to engage the contactor 156. Opposite displacement of the member 200, in a direction to which the member 200 is biased through the integral portion 202 by the aforesaid means (not shown) biasing the plunger 120, is permitted by suitable relief 204 on the tank 106.

Also on its inner side, the member 200 carries a valve operator 206, which is L-shaped as shown in FIG. 5, a transverse portion 208 of which engages an annular element 210 carried by the valve stem 112 so as to open the burner valve 110 upon longitudinal displacement of the member 200 to actuate the ignition device 118, and which has a slot 212 passing the integral portion 202 of the member 200 and allowing relative displacement of the member 200 and the valve operator 206 so as to enable the burner valve 110 to be easily fitted and adjusted in order to set the flame size. The valve operator 206 may be suitably connected to the member 200 so as to prevent disassembly of the valve operator 106 and the member 200.

The sleeve 100 is provided with an actuating aperture 220 through which an operating member 222 engages the actuating member 200. Plural connecting bosses 224, 226, and 228 on the operating member 7, on its inner side, snap into suitable receiving apertures 230 (not shown) in the actuating member 200, so as to facilitate assembly and disassembly of the operating member 222 and the actuating member 200. The bosses 224 and 228 are slotted, as shown in FIG. 5, so as to provide secure fits of the bosses 224 and 228 into the proper apertures. The operating member 222 is assembled to the actuating member 200, after the sleeve 100 is telescoped over the several components secured by the sleeve 12, and after a cotter 236 to be described below is inserted.

The cotter 236, which is yoke-shaped, straddles the burner valve 110 between annular elements 238 and 240 on the burner valve 110 so as to limit longitudinal displacement of the actuating member 200 toward the tank 106. The cotter 236 is inserted, through the actuating aperture 220, and through an aperture 260 in the actuating member 200, after the sleeve 100 is telescoped over the several components secured by the sleeve 100, but before the operating member 222 is attached.

Near its right end as shown in FIG. 5, the tank 106 is molded or provided otherwise with an integral projection 242, which is seated in a complementary recess 244 in the sleeve 100 and a complementary recess 246 in the cap 132, so as to assure rotational alignment of the sleeve 100 and the tank 106 for proper assembly of the lighter. In comparison with the projection 14 of the lighter of FIGS. 1 through 4, the projection 242 is rotated 90°, as a matter of choice.

A cap 250, which fits within the sleeve 100, and which is affixed to the burner element 116, provides a flame orifice (not shown) of a predetermined size, as in the lighter of FIGS. 1 through 4. Air flow into the burner element 116 is permitted by suitable orifices 252 in the sleeve 100.

In the lighter of FIG. 5, the tank 106, the burner valve 110, the tube 114, the electrode 126, and the filler valve (not shown) may be considered as one subassembly, the piezo-electric ignition element 118, the electrode 122, and the lead 124 may be considered as another subassembly, and the member 200 and the operator 206 may be considered another subassembly. These subassemblies and other components of the lighter may be assembled and disassembled easily and without tools.

In assembly of the lighter, the tank 106 is connected to the holder 140 and the electrode 126 is fitted into the slot 190 in the wall 192 of the holder 140, the ignition device 118 is seated in the holder 140 and the electrode 122 is placed in the channel 150, the leaf spring 130 is mounted by means of the resilient pad 182, and the burner element 116 is connected to the holder 140 so as to secure the electrode 122. Next, the member 200 is fitted onto the holder 140, so as to cause the transverse portion 208 of the operator 206 to engage the annular element 210, and the sleeve 100 is telescoped over the components as assembled thus far. Finally, the cotter 236 is inserted, and the member 222 is attached to the member 200.

In the assembled lighter, the burner element 116 shapes and controls a flame from fuel burner in a burner or combustion space, at the left end of the lighter as shown in FIG. 5. The burner or combustion space is intruded by the electrodes 122 and 126 and is fed with fuel from the tank 106 through the tube 114.

It is to be understood that the embodiments described above are exemplary and not intended to limit this invention as covered by the claims below.

I claim:

1. In a gas lighter of a type comprising a cylindrical tank provided with a burner valve, a conduit connecting the burner valve to a combustion space, a subassembly comprising a substantially semi-cylindrical holder and a semi-cylindrical axially displaceable actuating member, and an electrical ignition device mounted in said holder and covered by said member, the actuating member being provided with means for operating the ignition device and means for opening the burner valve, an improvement wherein a one-piece tubular sleeve surrounds and holds together the tank, the holder, and the actuating member, the sleeve having an aperture therein to permit manual movement of the actuating member.

2. The improvement according to claim 1 wherein the means for operating the ignition device comprises a projection on the actuating member, and wherein the means for opening the burner valve comprises a member displaceably mounted on the projection.

3. The improvement according to claim 1 wherein a projection on the tank enters a recess in the sleeve when the lighter is assembled.

4. The improvement according to claim 2 wherein a projection on the tank enters a recess in the sleeve when the lighter is assembled.

5. The improvement according to claim 1, in a gas lighter of said type in which the cylindrical tank also is provided with a filler valve, wherein the filler valve is accessible through an open end of the sleeve.

6. The improvement according to claim 1 wherein the tank is connected to the holder by means preventing relative displacement of the tank and the holder within the sleeve.

7. The improvement according to claim 1, in a gas lighter of said type which also comprises a burner element, wherein the burner element is connected to the holder at an open end of the sleeve so as to be surrounded and held together with the tank, the holder, and the actuating member, by the sleeve.

8. The improvement according to claim 7 wherein the tank is connected to the holder by means preventing relative displacement of the tank and the holder within the sleeve.

9. The improvement according to claim 8, in a gas lighter of said type in which the cylindrical tank also is provided with a filler valve, wherein the filler valve is accessible through another open end of the sleeve.

10. The improvement according to claim 9 wherein the means for operating the ignition device comprises a projection on the actuating member, and wherein the means for opening the burner valve comprises a member displaceably mounted on the projection.

* * * * *